US005263669A

United States Patent [19]

Ehrlich

[11] Patent Number: 5,263,669

[45] Date of Patent: Nov. 23, 1993

[54] RAILWAY CAB SIGNAL TRANSMITTER

[75] Inventor: Anthony G. Ehrlich, Pittsburgh, Pa.

[73] Assignee: Union Switch & Signal Inc., Pittsburgh, Pa.

[21] Appl. No.: 883,643

[22] Filed: May 15, 1992

[51] Int. Cl.[5] ..... B61L 3/20

[52] U.S. Cl. ..... 246/34 B; 246/59; 246/62; 246/180

[58] Field of Search ..... 246/28 R, 34 R, 34 A, 246/34 B, 34 CT, 40, 55, 59, 62, 63 R, 63 C, 167 R, 180; 340/825.36, 825.49, 825.72, 825.44, 310 R

[56] References Cited

U.S. PATENT DOCUMENTS

| | | | |
|---|---|---|---|
| 1,975,371 | 10/1934 | Place | 246/63 C X |
| 2,019,166 | 10/1935 | Whitelock | 246/8 |
| 2,029,396 | 2/1936 | Sorensen | 246/8 X |
| 2,129,313 | 9/1938 | Whitelock | 330/122 |
| 2,287,144 | 6/1942 | Staples | 246/34 R |
| 2,662,971 | 12/1953 | Howard | 246/34 B |
| 2,828,363 | 3/1958 | Ray | 370/11 |
| 2,947,814 | 8/1960 | Haner, Jr. | 375/65 |
| 3,021,506 | 2/1962 | Haner et al. | 340/825.18 |
| 3,312,875 | 4/1967 | Mayer | 340/825.44 X |
| 3,879,004 | 4/1975 | Andreasen | 246/62 |
| 3,946,972 | 3/1976 | Grundy | 246/34 CT |
| 4,298,179 | 11/1981 | Gilcher | 246/34 R |
| 4,392,626 | 7/1983 | Pascoe | 246/34 R |
| 4,535,959 | 8/1985 | Gilcher | 246/34 R |
| 4,619,425 | 10/1986 | Nagel | 246/34 R |
| 4,720,067 | 1/1988 | Jaeger | 246/34 B |

*Primary Examiner*—Michael S. Huppert
*Assistant Examiner*—Scott L. Lowe
*Attorney, Agent, or Firm*—Buchanan Ingersoll

[57] ABSTRACT

A transmitter for transmitting cab signal and track signal currents to a pair of rails includes the circuitry for mitigating runby currents which are not fully shunted by the rail vehicle. High runby currents at the leaving end of a block are reduced by sensing the presence of a railway vehicle in the leaving end of the block. In response to sensing the rail vehicle the cab signal voltage is reduced to a lower level. The lower level and the position at which the railway vehicle is sensed are adjusted so as to permit a lead vehicle to receive at least a minimum cab signal value throughout its journey while assuring that following trains receive less than the minimum cab value required to activate the vehicle based receiver. The train is sensed by the voltage drop across the rails as the train approaches. A relay is used to respond to the presence of the train by applying a lower cab signal to the rails.

14 Claims, 5 Drawing Sheets

RAILWAY CAB SIGNAL TRANSMITTER

BACKGROUND OF THE INVENTION

Automatic block signal systems using wayside signals provide the primary control for railway vehicle operation, but it is often desirable to have additional, on-board signal displays. On-board, or cab signals, are particularly useful where rain, fog, or other environmental conditions make it difficult to see the wayside signal aspect. In addition, cab based signal displays permit a railway vehicle operator to monitor changing track condition after the train has entered a block. Without cab signaling the train may only be permitted to proceed at a restricted speed, even if the block has been cleared.

Cab signaling is well-known and has been used for many years with a transmitter applying a signal to the rails, and a railway vehicle mounted receiver inductively sensing the coded cab signal current being fed to the track rails. Receiver coils mounted on the locomotive ahead of the leading wheels are often used to sense cab signals. The rail current between the transmitter and the leading axle is inductively sensed by the railway vehicle receiver and the appropriate signal is displayed in the vehicle cab.

When a train crosses the insulated joints at the entering end of an unoccupied track circuit, its cab signal receiver will begin to sense the coded cab signal current in the rails immediately ahead of the leading axle. As the train proceeds through the track circuit, the level of this signal gets progressively higher as the rail impedance between the signal source and the train decreases. In track circuits the rail current can be as high as 20 amperes when the train reaches the exit or leaving end, whereas the current required to energize the cab receiver may be as low as 1.3 amperes. While the rail current is being sensed in advance of the leading axle, a certain amount of the track current that carries the cab signal is shunted through the railway vehicle wheel and axle assemblies, often referred to as a train shunt. If the impedance of the train shunt is above zero, even by as little as a few hundredths of an ohm, enough cab signal rail current may bypass the train (runby current) to cause pickup of the cab signals by the receiver of a following train. This runby cab signal current can, if sufficiently large, cause a second or following train to erroneously detect the clear signal intended for the lead train. Because the rail impedance and the ballast between the trains act to reduce the level of current reaching the following train, the problem of bypass current is particularly bothersome when the following train is in relatively close proximity to the lead train. In this condition, a substantial portion of the bypass current from the lead train is available to be sensed by the following train, and is highly undesirable.

SUMMARY OF THE INVENTION

Because the runby current under a lead train is highest at the leaving end of the block, the invention provides for means to detect the approach of a train near the leaving end of the block and, when a train is detected there, to reduce the level of cab signal current applied to the rails in response to sensing such approach. Because of the increasing voltage drop across a series impedance with the track load, as the train approaches the voltage reduction on the rails causes the dropping out of a relay which in turn reduces the cab signaling voltage applied to the track circuit. The relay drop out is adjusted to sense the approaching railway vehicle at a position where runby cab signal current could exist at a level high enough to be erroneously interpreted by a following vehicle. Multiple taps on the code signal source transformer can be used to provide a reduced code signal level when said relay drops out.

DESCRIPTION OF PRESENTLY PREFERRED EMBODIMENTS

Figure 1:
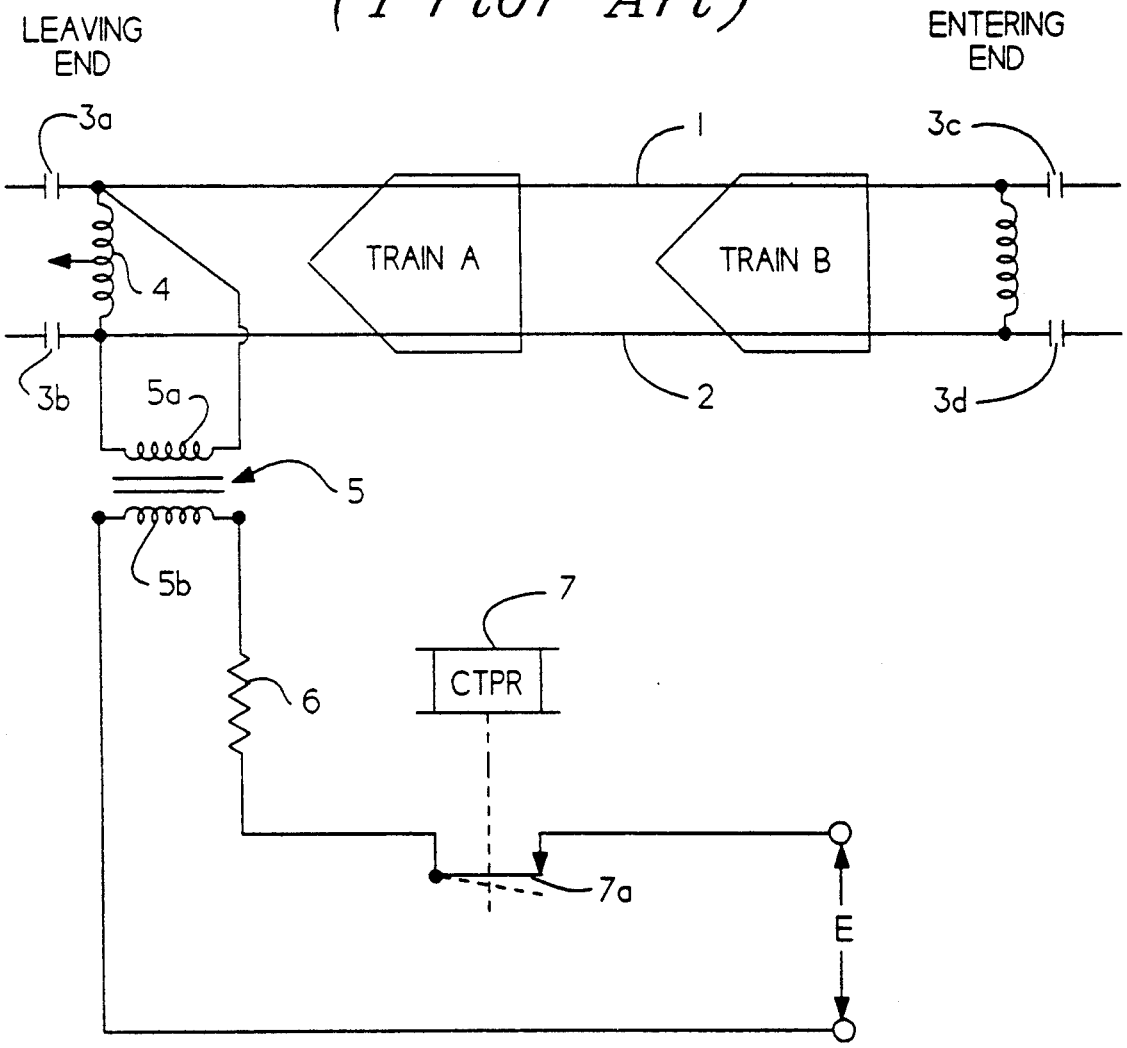
Fig.1. (Prior Art)
FIG. 1 is a diagrammatic representation of a prior art cab signal transmitter with leading train A and following train B.

FIG. 1 shows a prior art railway cab signal transmitter which supplies a coded cab signal to rails 1 and 2. Rails 1 and 2 are part of a block separated from adjacent tracks by joints 3*a*–3*d*. The transmitter is attached to the rails at the leaving end of the block, which also contains impedance bond 4 shunting the rails 1 and 2. A feed transformer 5 having a secondary winding 5*a* connected across the rails and a primary winding 5*b* is also used. Connected to the primary winding 5*b* is a current limiting resistor 6. A CTPR or code transmitter repeater 7 has contacts 7*a* which alternately open and close to code the signal from the input voltage E. In this circuit CTPR and input E provide a means for generating a coded cab signal. Typically both trains A and B would have railway cab signal receivers onboard. The receivers are well-known and these devices do not form part of this invention. The onboard receivers generally sense the current in advance of the leading wheel and axle assembly on each respective train. This figure shows the trains diagrammatically; and as the expression train is often used in this specification, it is understood that the train may be a single or multi-car locomotive or transit vehicle capable of carrying freight or passengers. But, regardless of the type of vehicle, the cab signaling will usually occur at, or in advance of, the lead axles. The wheel and axle assemblies of the train provide electrical shunts between rails 1 and 2. The voltage E and the value of resistor 6 are chosen such that the preceding train A can reliably sense the cab signal upon entering the block. As train A advances toward the leaving end, it does indeed shunt an appreciable amount of the rail current, but simultaneously the rail current will increase due to the fact that the rail impedance between the leaving end and the train is reduced.

Figure 2:
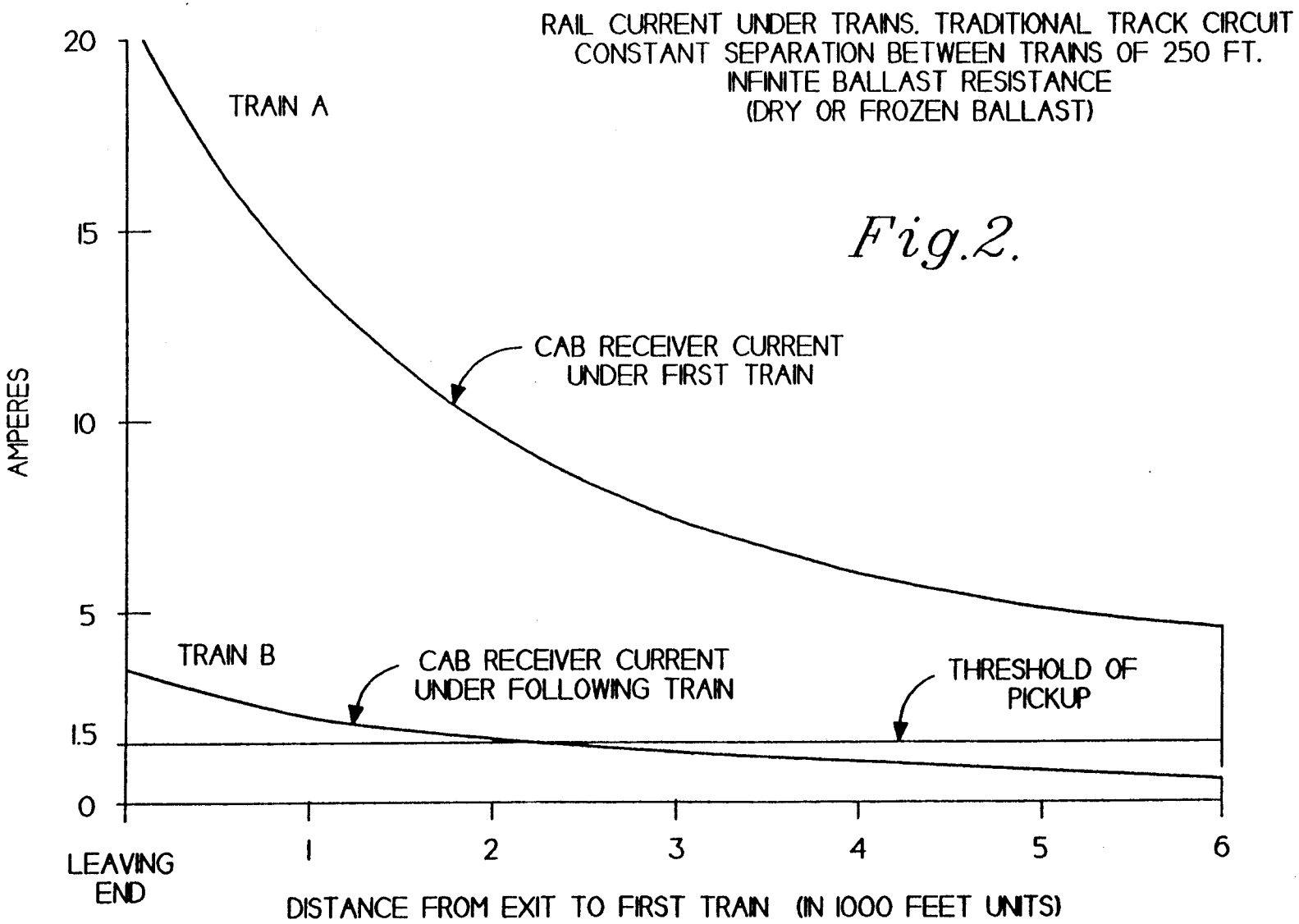
FIG. 2 is a diagram of the rail current available to two trains in close proximity within a block using a cab signal transmitter such as that shown in FIG. 1.

FIG. 2 shows the rail current that could be sensed by train A and train B as they move through the block. In this example the circuit parameters of the code signal transmitter of FIG. 1 have been adjusted to provide an entering end axle current of 2 amperes under minimum ballast resistance conditions of 3 ohms per thousand feet. The curves depict the current levels at infinite ballast resistance. This graph assumes that there is a constant separation between train A and train B of two hundred and fifty feet. As train A approaches the leaving end the current in the rails beneath it increases greatly. In this example 1.5 amperes has been assumed to be the minimum cab signal rail current necessary to be detected by the cab based receiver. It is clear that train A at all times can detect the cab signal. Upon entering the block, trailing train B cannot detect the cab signal because the runby coded cab signal rail current is less than 1.5 amperes. However, as train A approaches the 2500 foot distance from the leaving end sufficient rail runby current will bypass train A and be available to be sensed by train B. At this position (2500 feet) trailing train B will be able to detect the 1.5 amperes of runby cab signal. Train B in this example is behind train A by 250 feet and is erroneously able to detect a clear signal which is intended to be received only by train A. As train A is about to leave the block the cab receiver current available to train B is approximately 3.5 amperes. This undesirable condition permits train B to display in its cab the signal intended for train A. FIG. 2 also shows current in excess of 20 amps in the rails as train A reaches the cab signal transmitter at the leaving end.

As previously described with regard to bypass current cab signals, such occur more readily at the leaving or exit end of a block where the rail current can become quite high. The invention detects the load resulting in such high currents as indicative of an approaching train and adjusts the code signal to a lower value.

Figure 3:
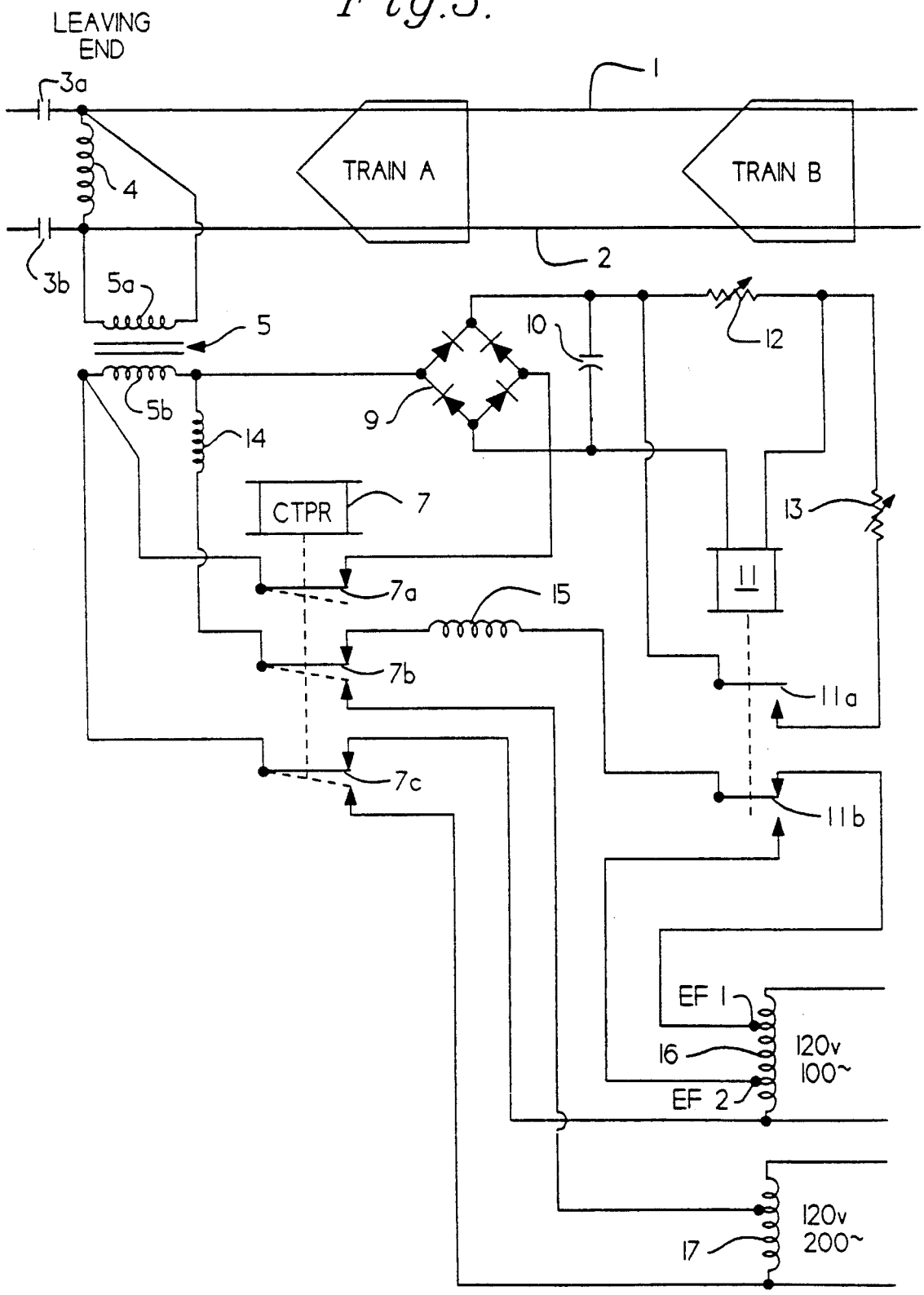
FIG. 3 is a presently preferred embodiment sensing load changes on the primary of the cab signal feed transformer and using both a 100 cycle cab signal and a 200 hertz track signal.

FIG. 3 shows rails 1 and 2 connected by an impedance bond 4 at the leaving end. Signals are applied to the rails by means of transformer 5 having secondary winding 5*a* connected across the rails. Cab signals from transformer 16 and wayside signals from transformer 17 can be applied to the primary winding 5*b* to transmit such signals to the rails. In normal operation the code transmitting repeater (CTPR) 7 periodically oscillates contacts 7*b* and 7*c* respectively to apply either the cab signal from transformer 16 or the wayside signal from transformer 17. Inductor 14 in series with the signals is used for current limiting and phasing and is a normal component of typical track circuits. In longer track circuits more inductance may be needed in the cab signaling circuit and reactor 15 can be inserted where required. When CTPR, 7, is in the down position contacts 7*b* and 7*c* connect the 120 volt 200 hertz wayside track signal transformer to the primary 5*b* through inductor 14. The 200 hertz track circuit signal is used for wayside controls and is not interpreted or subject to misinterpretation by trains A or B in FIG. 3. However, when CTPR moves to the upward position, the cab signal transformer 16 is now applied to the primary winding 5*b* of transformer 5 and via the secondary winding 5*a* the cab signal current is delivered to rails 1 and 2. A second set of leads come off of the transformer primary 5*b* and lead to the rectifying bridge 9. However, because of the operation of CTPR contact 7*a*, the rectifier bridge 9 is not operational except when the CTPR is in the up or cab signal position. When the CTPR is in the up position, contact 7*a* is closed and the primary voltage on transformer 5*b* is placed across the rectifier bridge 9. The rectified voltage is then applied to the series combination of resistor 12 and relay 11. If train A is far from the leaving end, or indeed if the track is unoccupied, then the voltage across 5*b* is high and relay 11 is caused to pickup. Relay 11 activates contact 11*b* to an up position which provides EFI from the cab signal transformer 16 through inductor 15 and inductor 14 to the primary of the track transformer 5. This full voltage level cab signal is then applied through the transformer 5 to rails 1 and 2. In addition to activating relay 11, the output of the rectifier bridge 9 also causes capacitor 10 to charge. Capacitor 10 is sized so as to discharge through relay 11 and prevent relay 11 from releasing during the coded periods where the input voltage to the rectifying bridge is off. This causes relay 11 to hold in its up position contact 11*b* connecting the full cab signal level EFI from transformer 16 to the contact 7*b*. As train A approaches the leaving end of the block, the rail current will increase, as previously shown. When the rail current increases to the level where a significant runby of cab signal rail current and the possibility for an erroneous signal being picked up by train B could exist, it is desired that relay 11 should drop out. This point at which relay 11 drops is controlled by variable resistor 12. If, for example, it is determined that 500 feet from the leaving end the rail current is sufficiently high that it is desired to avoid runby currents the resistor R12 can be adjusted such that when train A reaches the 500 foot position from the leaving end the voltage on the primary 5*b* when rectified and fed through resistor 12 will be insufficient to hold relay 11 upward and relay will drop causing contacts 11*a* to close and 11*b* to move to its lower position. At this point contact 11*b* will move from the EFI tap to the EF2 tap on code signal transformer 16. The EF2 tap on transformer 16 has been chosen to provide sufficient current in the rail that train A can detect the code signal at the 500 foot approach distance. In this example it is to be understood 500 feet is being used as the approach distance where relay 11 drops, it being understood that other approach distances are equally included within the scope of this invention.

Once relay 11 is caused to drop resistor 13 is placed in parallel around resistor 12 reducing the series resistance in the relay 11 circuit and making the circuit more sensitive for pickup. The pickup of relay 11 is therefore controlled by the parallel combination of resistors 12 and 13, while the dropout is controlled only by resistor 12. Typical values for resistors 11 and 12 are of the order of thousands of ohms and are adjustable depending on the specific track configurations and the relay 11 used in the circuitry. When relay 11 has dropped and the code circuit is now being supplied via contact 11*b* from code transformer terminal EF2 the rail current available for runby of train 1 is greatly reduced.

Figure 4:
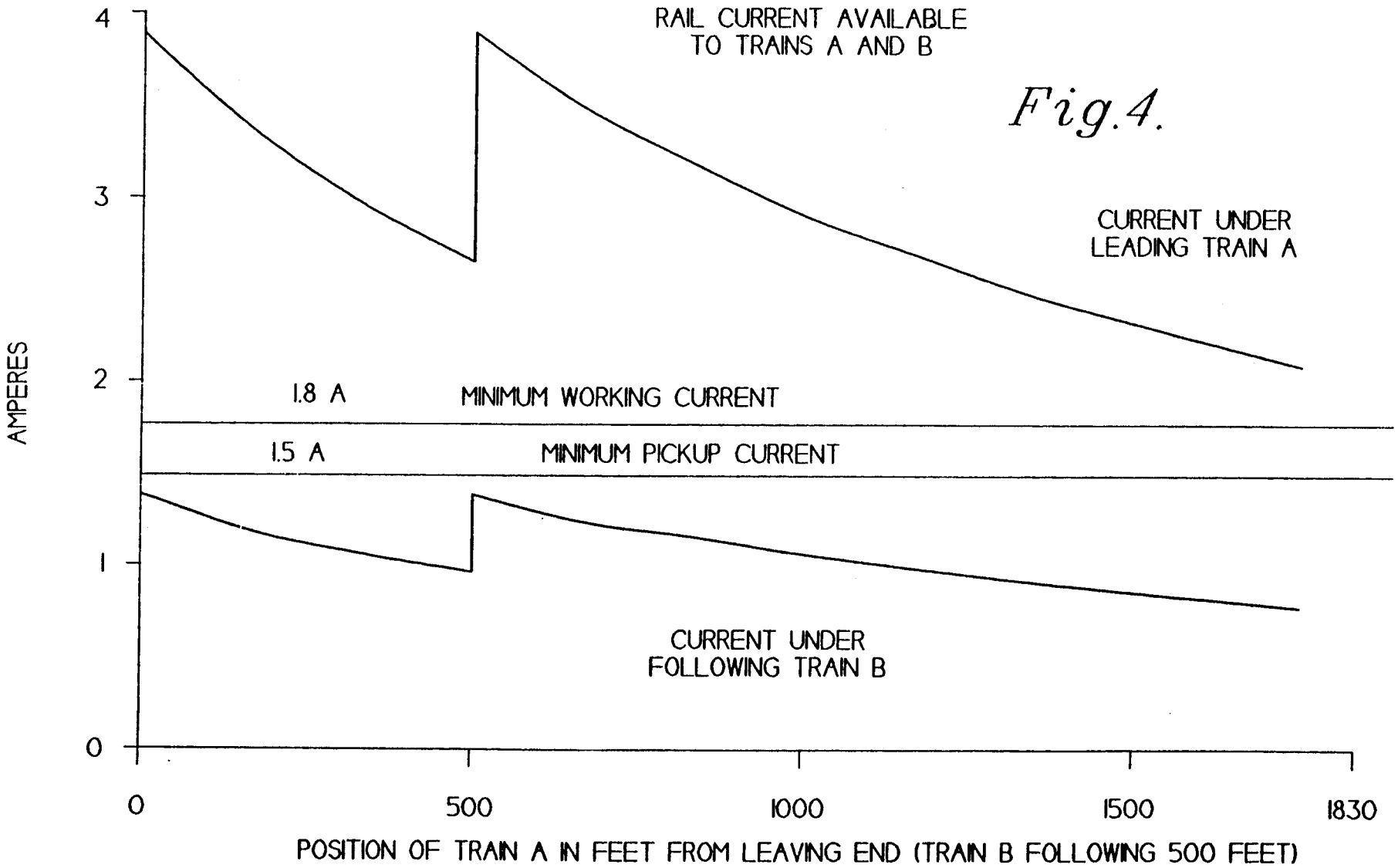
FIG. 4 is a cab signal current diagram for the two trains shown in FIG. 3.

FIG. 4 shows a diagrammatic representation of the rail current available to trains A and B from the circuit of FIG. 3. As can be seen the current available to be sensed by the leading train A at 1800 feet from the leaving end is well above the 1.8 amps necessary to reliably activate the cab signal receiver. In addition the current under the following train B is less than the 1.5 amps minimum necessary for the cab signal receiver in the train B to be activated. Therefore, train B does not receive the clear cab signal which train A will reliably receive at the 1800 foot point. As train A progresses through the block towards the leaving end, the current under train A steadily increases until it reaches the 500 foot approach distance. Train B current (runby) has also increased but remains slightly below the 1.5 amps minimum needed to activate the cab signal on train B. At 500 feet the relay 11 in FIG. 3 senses the presence of train A at the approach distance by the high load on transformer 5 which has caused a voltage drop across both inductances 14 and 15. As a result the voltage across 5B is less than necessary to supply adequate current through relay 11 and relay 11 is caused to drop. As a result the applied voltage from code signal transformer 16 is reduced from EFI to EF2, with the resulting drop in rail current as seen at the 500 foot position on FIG. 4. As train A continues to approach the leaving end of the block the current in the rail beneath train A will continue to build until it reaches a maximum at approximately 4 amps on leaving the block. As the leading train A is shunting the leaving end of rails 1 and 2 the peak current seen by following train B is still less than the 1.5 amps necessary to activate the cab based receiver in train B. In addition during the transition and at all times train A has had at least the 1.8 amps necessary to reliably hold the cab signal. The 1.8 amps is assumed to be the minimum working value of the cab based receiver and this value has been maintained at the rails beneath train A throughout its journey.

Even after train A leaves the block the cab signal applied voltage will remain at the EF2 level if train B is within the pre-established approach distance, such as 500 feet used in this example. Because train A is no longer shunting rail current through its wheel and axle assemblies the reduced voltage EF2 available to train 2 will be sufficient to provide current under train 2 greater than the 1.5 necessary to activate its cab signal receiver. If train B is a distance further than the approach or relay drop distance, such as the 500 foot example, then the load on transformer 5 will decrease and the train sensing circuitry will not detect the train and relay 11 will pickup, thereby applying full EFI cab signal voltage to transformer winding 5*a*. The train sensing circuitry which detects the increased load of the rails 1 and 2 functions even when only one train is present. In this way it reduces the high currents and resulting power necessary from feed transformer 5 as trains approach the leaving end of the block.

Figure 5:
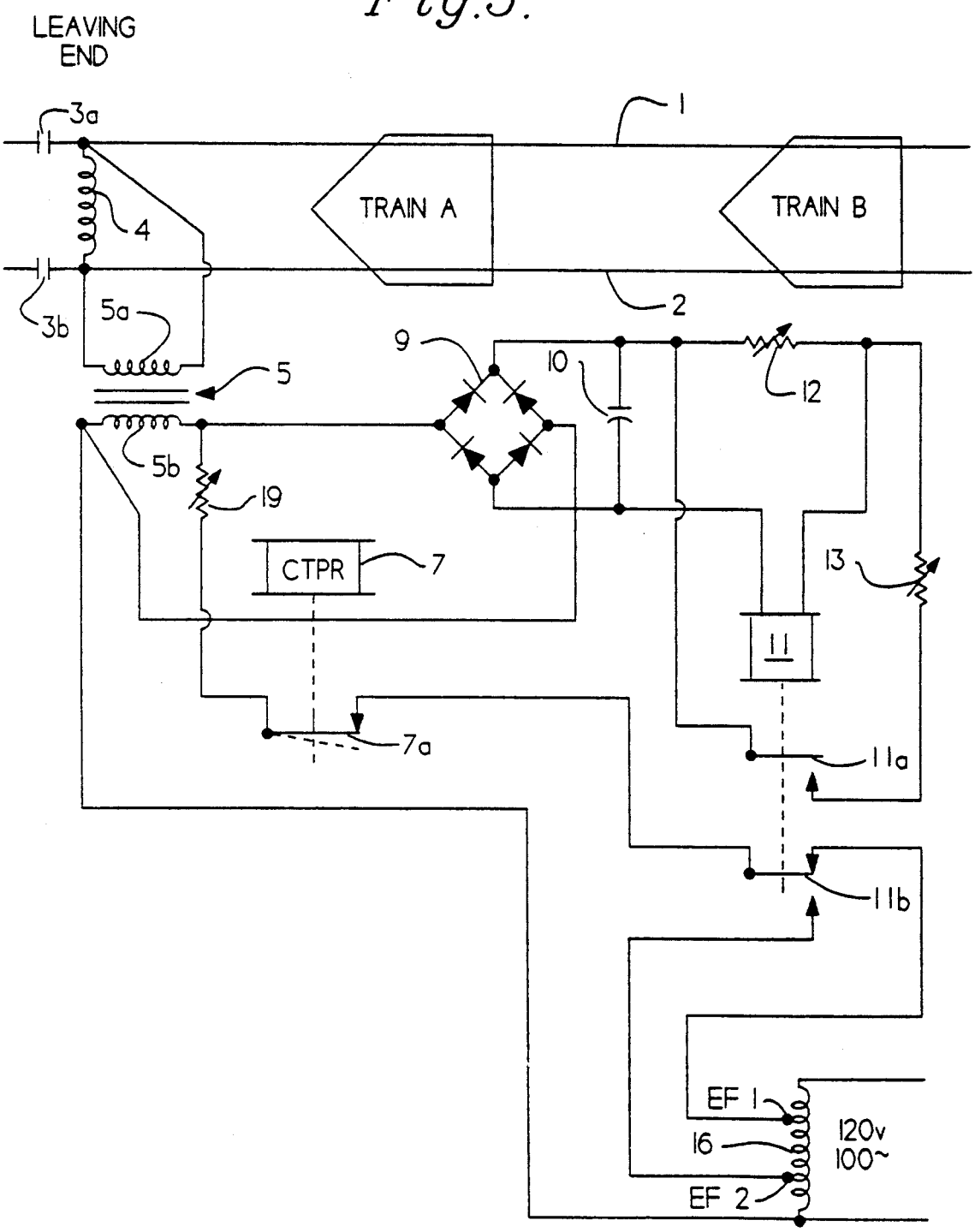
FIG. 5 is a diagram of a presently preferred embodiment in which a 100 hertz signal is used for both the cab signal and the wayside track signal.

Referring to FIG. 5 there is shown a transmitter which can be used where both cab and wayside signaling are at a frequency of 100 hertz. A current limiting resistor 19 is shown as typically used in such an application. When relay 11 is not activated or picked up, contact 11*b* provides EF2 output to the CTPR contacts. The reduction in signal strength while a train is being detected within the approach distance is not important to the wayside track receiver as it is desired that such signal receiver behind the approaching train display an occupied track.

Certain presently preferred embodiments have been shown in FIG. 5, and it is understood that the respective train A and train B have rail currents similar to those which have been described with regard to FIG. 4. While certain presently preferred embodiments of the invention have been described, it is understood that other embodiments are included within the scope of the following claims.

I claim:

1. A railway cab signal transmitter to supply coded cab signals to a set of railway rails in the form of rail current for reception by a railway vehicle, said transmitter comprising:

a transformer having a secondary winding connected across said rails at a leaving end of a block and a primary winding;

a cab signal source connected to said primary winding, said source having at least a higher voltage output and a lower voltage output;

detection means to sense an approach of said railway vehicle at said leaving end of said block; and switch means for switching said source to said lower voltage output when said detection means senses said approach of said railway vehicle at said leaving end, thereby reducing the rail current supplied by said railway cab signal transmitter to said set of railway rails and thus correspondingly reducing any runby rail current existing behind said railway vehicle.

2. The railway cab signal transmitter of claim 1 further including:

a coded track signal source;

a code transmitting repeater to alternately connect one of said coded track signal source or said cab signal source to said primary winding of said transformer;

said code transmitting repeater including switch contacts to cause said detection means to sense said approach of said railway vehicle only during a period when said cab signal source is connected to said primary winding; and said detection means including a relay having a relay coil connected to one of said primary or secondary windings of said transformer; and said switching means including at least one set of contacts on said relay operable to alternatively connect one of said two voltage outputs of said cab signal source to the primary winding of said transformer.

3. The railway cab signal transmitter of claim 2 further including a rectifier bridge connected across said one of said primary or secondary windings of said transformer, said relay being DC operated, said rectifier bridge having a DC output feeding said relay coil and including a capacitor across said DC output of said bridge to maintain operation of said relay for a preselected period.

4. The railway cab signal transmitter of claim 1 wherein said detection means includes a relay having a sensing coil connected across one of said primary or secondary windings of said transformer; and said switching means includes at least one set of contacts on said relay, said at least one set of contacts being operable to alternately select one of said two voltage outputs of said source to be available to the primary of said transformer.

5. The railway cab signal transmitter of claim 4 further including adjustment means for selectively adjusting the operation of said relay.

6. The railway cab signal transmitter of claim 5 wherein said adjustment means is a resistance in series with said sensing coil and said relay further includes a second set of contacts to effectively decrease the resistance in series with said sensing coil when said detection means senses said approach of said railway vehicle.

7. The railway cab signal transmitter of claim 5 further including a rectifier bridge connected across said one of said primary or secondary windings of said transformer, said relay being DC operated, said rectifier bridge having a DC output feeding said sensing coil and including a capacitor across said DC output of said bridge to maintain operation of said relay for a preselected period.

8. The railway cab signal transmitter of claim 5 further including a series impedance between said cab signal source and said primary winding of said transformer; and wherein said sensing coil is connected across said primary winding of said transformer; and wherein said adjustment means is a resistance in series with said sensing coil, and said relay further includes a second set of contacts to effectively decrease the resistance in series with said sensing coil when said detection means senses said approach of said railway vehicle.

9. The railway cab signal transmitter of claim 8 further including a rectifier bridge connected across said one of said primary or secondary windings of said transformer, said relay being DC operated, said rectifier bridge having a DC output feeding said sensing coil and including a capacitor across said DC output of said bridge to maintain operation of said relay for a preselected period.

10. The railway cab signal transmitter of claim 5 further including a series impedance between said cab signal source and said primary winding of said transformer.

11. The railway cab signal transmitter of claim 10 further including a rectifier bridge connected across said one of said primary or secondary windings of said transformer, said relay being DC operated, said rectifier bridge having a DC output feeding said sensing coil and including a capacitor across said DC output of said bridge to maintain operation of said relay for a predetermined period.

12. The railway cab signal transmitter of claim 5 wherein said adjustment means is operable to set and adjust an approach distance measured between said railway vehicle and said leaving end of said block, said approach distance being defined at a point in time when said detection means first senses said approach of said railway vehicle, said approach distance being set to a distance corresponding generally to a distance whereat said runby current existing behind said railway vehicle is greater than a minimum current level required to initiate a cab signal in any following vehicle behind said railway vehicle.

13. The railway cab signal transmitter of claim 12 further including a series impedance between said cab signal source and said primary winding of said transformer.

14. The railway cab signal transmitter of claim 13 wherein said sensing coil is connected across said primary winding of said transformer.

* * * * *